US010480305B2

(12) United States Patent
El-Bakry et al.

(10) Patent No.: US 10,480,305 B2
(45) Date of Patent: Nov. 19, 2019

(54) AUTOMATED WELL TEST VALIDATION

(71) Applicants: Amr El-Bakry, Houston, TX (US); Joseph K. Bjerkseth, Cold Lake (CA); Niranjan A. Subrahmanya, Three Bridges, NJ (US); Peng Xu, Annandale, NJ (US)

(72) Inventors: Amr El-Bakry, Houston, TX (US); Joseph K. Bjerkseth, Cold Lake (CA); Niranjan A. Subrahmanya, Three Bridges, NJ (US); Peng Xu, Annandale, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 345 days.

(21) Appl. No.: 15/229,658

(22) Filed: Aug. 5, 2016

(65) Prior Publication Data

US 2017/0058659 A1 Mar. 2, 2017

Related U.S. Application Data

(60) Provisional application No. 62/212,311, filed on Aug. 31, 2015.

(51) Int. Cl.
*E21B 44/00* (2006.01)

(52) U.S. Cl.
CPC ..... *E21B 44/00* (2013.01)

(58) Field of Classification Search
CPC ..... E21B 44/00; E21B 21/002; E21B 21/003; E21B 21/063; E21B 21/067; E21B 43/34; C02F 2101/32
See application file for complete search history.

(56) References Cited

U.S. PATENT DOCUMENTS 4,616,700 A * 10/1986 Wood ..... E21B 34/16 166/250.08
8,892,407 B2 11/2014 Budiman et al.
2003/0157721 A1* 8/2003 Turner ..... B01F 15/00201 436/148
2008/0015792 A1* 1/2008 Scott ..... G01N 22/00 702/25
2012/0090834 A1 4/2012 Imhof et al.
(Continued)

*Primary Examiner* — Mohamed Charioui
*Assistant Examiner* — Catherine T. Rastovski
(74) *Attorney, Agent, or Firm* — ExxonMobil Upstream Research Company—Law Department

(57) ABSTRACT

A diagnostic apparatus configured to communicate with a well test system comprising a plurality of wells in a field, comprising a receiving component configured to receive a well test data from the well test system, a transmitting component configured to transmit an abnormal well test signal indication, at least one processor configured to communicate with the transmitting component and the receiving component, and a memory coupled to the at least one processor, wherein the memory comprises instructions that when executed by the at least one processor cause the diagnostic apparatus to compare the well test data to one or more well test descriptors stored in memory, correlate the well test data to an abnormal well test result selected based at least in part on the comparison with the one or more well test descriptors stored in the memory, and instruct the transmitting component to transmit an abnormal well test signal indication to a recipient.

17 Claims, 4 Drawing Sheets

(56) References Cited

U.S. PATENT DOCUMENTS

| | | | | |
|---|---|---|---|---|
| 2012/0118637 | A1 | 5/2012 | Wang et al. | |
| 2012/0123756 | A1 | 5/2012 | Wang et al. | |
| 2013/0110485 | A1 | 5/2013 | Li et al. | |
| 2013/0204922 | A1 | 8/2013 | El-Bakry et al. | |
| 2013/0246032 | A1 | 9/2013 | El-Bakry et al. | |
| 2013/0255939 | A1 | 10/2013 | Kumaran et al. | |
| 2014/0096836 | A1* | 4/2014 | Romero Maimone | E21B 43/34 137/10 |
| 2014/0283609 | A1 | 9/2014 | Macleod et al. | |
| 2016/0333686 | A1* | 11/2016 | Scott | E21B 49/08 |

* cited by examiner

AUTOMATED WELL TEST VALIDATION

CROSS-REFERENCE TO RELATED APPLICATION

This application claims the benefit of U.S. Provisional Patent Application 62/212,311 filed Aug. 31, 2015 entitled AUTOMATED WELL TEST VALIDATION, the entirety of which is incorporated by reference herein.

BACKGROUND

Well testing is the term generally used to describe the process used to obtain valuable well information, e.g., determining a well's production rates, for managing wells and fields. Well tests may be conducted on a regular basis (e.g., daily) or on an as-needed basis for planning future operations. The quality of well tests may vary significantly. Low quality and invalid well tests generate misleading information, thus, must be identified. Well test validation is commonly used to determine the quality of a particular well test.

Traditionally, field operators perform well test validation in the field using limited information. For example, field operators may compare current well test rates with previous well test rates to try to determine whether the current well test is valid. Because these field analyses utilize limited information and rely on small sample sizes and operator capabilities, such field analyses may be subject to unacceptable error rates. Alternatively, engineers remote from the field may analyze the well test data to identify patterns associated with valid and invalid well tests and determine whether a test is valid. This time consuming process relies on the expert knowledge of very experienced engineers for reliable outcomes. Such an approach is not feasible to scale up once the number of well test is large. Moreover, current approaches only provide indication that the well tests are valid and/or invalid and do not provide a fuller explanation of underlying causation for invalid well tests.

Consequently, a need exists for a reliable way to determine the quality of particular well tests. Further, a need exists for a technique to perform well test validation in a rapid manner. Also, a need exists for a scalable practice of well test validation capable of rapidly evaluating even large numbers of well tests. Additionally, a need exists for an approach that identifies the underlying causation for invalid well tests.

SUMMARY

One embodiment includes a diagnostic apparatus configured to communicate with a well test system comprising a plurality of wells in a field, comprising a receiving component configured to receive a well test data from the well test system, a transmitting component configured to transmit an abnormal well test signal indication, at least one processor configured to communicate with the transmitting component and the receiving component, and a memory coupled to the at least one processor, wherein the memory comprises instructions that when executed by the at least one processor are configured (e.g., cause the diagnostic apparatus) to compare the well test data to one or more well test descriptors stored in the memory (local memory or a database), correlate the well test data to an abnormal well test result selected based at least in part on the comparison with the one or more well test descriptors stored in the memory (e.g., local memory or a database, and instruct the transmitting component to transmit an abnormal well test signal indication to a recipient.

Another embodiment includes a method of detecting an abnormal well test in a well test system comprising a plurality of wells in a field, comprising receiving a well test data from the well test system, segmenting the well test data into a purge period and a test period, wherein the purge period comprises information indicating oil, water, or both leaving a multiphase separator in the well test system, and wherein the test period comprises information indicating oil, water, or both entering the multiphase separator, calculating a water cut or at least one liquid rate from the test period well test data, wherein the liquid rate comprises an oil flow rate, a water flow rate, or a combination thereof, comparing the water cut, the liquid rate, or a combination thereof to a predetermined value, and detecting the abnormal well test based on the comparison.

Still another embodiment includes a well test system, comprising a field comprising a one or more wells, a multiphase separator configured for well testing the one or more wells, at least one sensor coupled to the multiphase separator, a communications infrastructure configured to provide communications from the sensor to a diagnostic apparatus, comprising a receiving component configured to receive a well test data from the well test system, a transmitting component configured to transmit an abnormal well test signal indication, at least one processor configured to communicate with the transmitting component and the receiving component, and a memory coupled to the at least one processor, wherein the memory comprises instructions that when executed by the at least one processor cause the diagnostic apparatus to compare the well test data to one or more well test descriptors stored in memory, such as local memory or a database, correlate the well test data to an abnormal well test result selected based at least in part on the comparison with the one or more well test descriptors stored in the memory, such as local memory or a database, and instruct the transmitting component to transmit the abnormal well test signal indication. The indication may be a flag or tag associated with the well test (e.g., well test started, well test ended, or other suitable notifications).

BRIEF DESCRIPTION OF THE DRAWINGS

The advantages of the present techniques are better understood by referring to the following detailed description and the attached drawings, in which.

DETAILED DESCRIPTION

Figure 1:
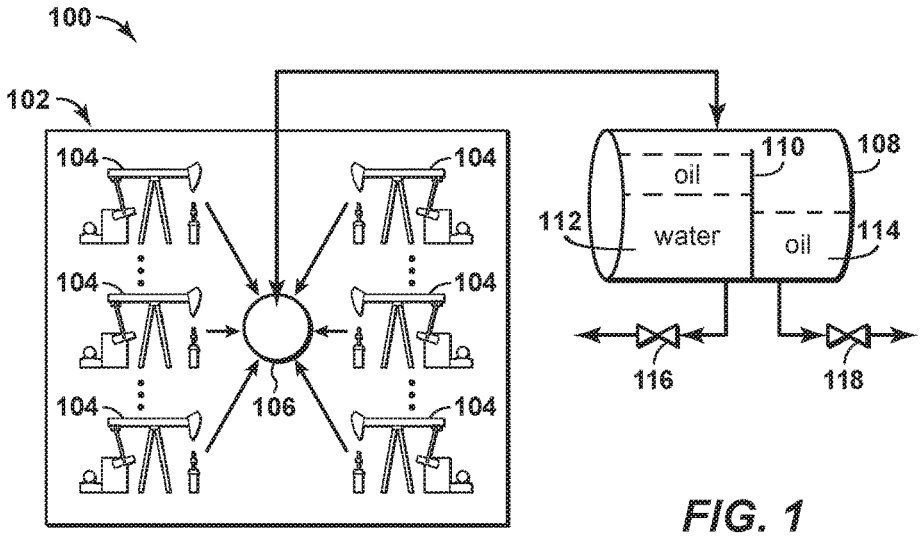
FIG. 1 is a schematic diagram of an exemplary well test system.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described herein, but rather, include all alternatives, modifications, and equivalents falling within the true spirit and scope of the appended claims.

At the outset, for ease of reference, certain terms used in this application and their meanings as used in this context are set forth. To the extent a term used herein is not defined herein, it should be given the broadest definition persons in the pertinent art have given that term as reflected in at least one printed publication or issued patent. Further, the present techniques are not limited by the usage of the terms shown herein, as all equivalents, synonyms, new developments, and terms or techniques that serve the same or a similar purpose are considered to be within the scope of the present claims.

As used herein, the term "computer component" refers to a computer-related entity, namely, hardware, firmware, software, a combination thereof, or software in execution. For example, a computer component can be, but is not limited to being, a process running on a processor, a processor, an object, an executable, a thread of execution, a program, and a computer. One or more computer components can reside within a process and/or thread of execution and a computer component can be localized on one computer and/or distributed between two or more computers.

As used herein, the terms "computer-readable medium," "non-transitory, computer-readable medium" or the like refer to any tangible storage that participates in providing instructions to a processor for execution. Such a medium may take many forms, including but not limited to, non-volatile media, and volatile media. Non-volatile media includes, for example, Non-Volatile Random Access Memory (NVRAM), or magnetic or optical disks. Volatile media includes dynamic memory, such as main memory. Computer-readable media may include, for example, a floppy disk, a flexible disk, hard disk, magnetic tape, or any other magnetic medium, magneto-optical medium, a Compact Disk Read Only Memory (CD-ROM), any other optical medium, a Random Access Memory (RAM), a synchronous RAM (SRAM), a dynamic random-access memory (DRAM), a synchronous dynamic RAM (SDRAM), a Programmable ROM (PROM), and Electrically Programmable ROM (EPROM), Electrically Erasable and Programmable ROM (EEPROM), a FLASH-EPROM, a solid state medium like a holographic memory, a memory card, or any other memory chip or cartridge, or any other physical medium from which a computer can read. When the computer-readable media is configured as a database, it is to be understood that the database may be any type of database, such as relational, hierarchical, object-oriented, and/or the like. Accordingly, exemplary embodiments of the present techniques may be considered to include a tangible, non-transitory storage medium or tangible distribution medium and prior art-recognized equivalents and successor media, in which the software implementations embodying the present techniques are stored.

"Computer communication," as used herein, refers to a communication between two or more computing devices (e.g., computer, personal digital assistant, cellular telephone) and can be, for example, a network transfer, a file transfer, an applet transfer, an email, a hypertext transfer protocol (HTTP) transfer, and so on. A computer communication can occur across, for example, a wireless system (e.g., IEEE 802.11), an Ethernet system (e.g., IEEE 802.3), a token ring system (e.g., IEEE 802.5), a local area network (LAN), a wide area network (WAN), a point-to-point system, a circuit switching system, a packet switching system, and so on. Wireless computer communications may utilize one or more of a plurality of communication protocols. Suitable wireless sensor network communications standards include Wireless HART, ISA100.11a, and other open or proprietary wireless protocols.

"Data store," as used herein, refers to a physical and/or logical entity that can store data. A data store may be, for example, a database, a table, a file, a list, a queue, a heap, a memory, a register, and so on. A data store may reside in one logical and/or physical entity and/or may be distributed between two or more logical and/or physical entities.

"Logic" or "logical," as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

An "operable connection," or a connection by which entities are "operably connected" or "operatively coupled" is, in the context of data transmission devices, one in which signals, physical communications, and/or logical communications may be sent and/or received. Typically, an operable connection includes a physical interface, an electrical interface, and/or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical and/or physical communication channels can be used to create an operable connection.

"Signal," as used herein, includes but is not limited to one or more electrical or optical signals, analog or digital signals, data, one or more computer or processor instructions, messages, a bit or bit stream, or other means that can be received, transmitted, and/or detected.

"Software," as used herein, includes but is not limited to, one or more computer or processor instructions that can be read, interpreted, compiled, and/or executed and that cause a computer, processor, or other electronic device to perform functions, actions and/or behave in a desired manner. The instructions may be embodied in various forms like routines, algorithms, modules, methods, threads, and/or programs including separate applications or code from dynamically linked libraries. Software may also be implemented in a variety of executable and/or loadable forms including, but not limited to, a stand-alone program, a function call (local and/or remote), a servlet, an applet, instructions stored in a memory, part of an operating system or other types of executable instructions. It will be appreciated by one of ordinary skill in the art that the form of software may be dependent on, for example, requirements of a desired application, the environment in which it runs, and/or the desires of a designer/programmer or the like. It will also be appreciated that computer-readable and/or executable instructions can be located in one logic and/or distributed between two or more communicating, co-operating, and/or parallel processing logics and thus can be loaded and/or executed in serial, parallel, massively parallel and other manners.

A "process" as used herein with respect to computer components (as distinguished from use with respect to an industrial process) means a sequence of processor or computer-executable steps leading to a desired result. These steps generally require physical manipulations of physical quantities. Usually, though not necessarily, these quantities take the form of electrical, magnetic, or optical signals capable of being stored, transferred, combined, compared, or otherwise manipulated. It is convention for those skilled in the art to refer to these signals as bits, values, elements, symbols, characters, terms, objects, numbers, records, files or the like. It should be kept in mind, however, that these and similar terms should be associated with appropriate physical quantities for computer operations, and that these terms are merely conventional labels applied to physical quantities that exist within and during operation of the computer.

It should also be understood that manipulations within the computer are often referred to in terms such as adding, comparing, moving, etc., which are often associated with manual operations performed by a human operator. It is understood that no such involvement of a human operator is necessary or even desirable in the present invention. The operations described herein are machine operations performed in conjunction with human operators) or users) who interact with the computer(s). The machines used for performing the operation of the present invention include general digital computers or other similar processing devices.

In addition, it should be understood that the programs, processes, methods, etc., described herein are not related or limited to any particular computer or apparatus. Rather, various types of general purpose machines may be used with programs constructed in accordance with the teachings described herein. Similarly, it may prove advantageous to construct specialized apparatus to perform at least a portion of the techniques described herein by way of dedicated computer systems with hard-wired logic or programs stored in nonvolatile memory, such as read only memory.

While for purposes of simplicity of explanation, the illustrated methodologies are shown and described as a series of blocks, it is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks. While the figures illustrate various serially occurring actions, it is to be appreciated that various actions could occur concurrently, substantially in parallel, and/or at substantially different points in time.

The present techniques may include an apparatus, system, or method. For example, the method may involve detecting an abnormal well test in a well test system comprising a plurality of wells in a field. The method may include receiving a well test data from the well test system; segmenting the well test data into a purge period and a test period, wherein the purge period comprises information indicating oil, water, or both leaving a multiphase separator in the well test system, and wherein the test period comprises information indicating oil, water, or both entering the multiphase separator; calculating a water cut or at least one liquid rate from the test period well test data, wherein the liquid rate comprises an oil flow rate, a water flow rate, or a combination thereof; comparing the water cut, the liquid rate, or a combination thereof to a predetermined value; and detecting the abnormal well test based on the comparison.

Further, the present techniques may include various enhancements. For example, the method may include that the abnormal well test indicates an incorrect test period duration, an incorrect filling period duration, a non-uniform dump-fill cycle duration, a low oil flow rate, an incorrect water cut, or any combination thereof; identifying a root cause for the abnormal well test; and/or identifying a corrective course of action; and alerting an operator to the abnormal well test, the root cause, the corrective course of action, or a combination thereof.

The method may also include that the predetermined value is selected to identify an incorrect test duration, an incorrect indication of oil, water or both leaving the multiphase separator, an incorrect indication of oil, water or both entering the multiphase separator, a faulty sensor, a multiphase separator problem, a flow stability problem, an equipment problem external to the multiphase separator, or any combination thereof; calculating a second water cut from the test period well test data, wherein the first water cut is representative of a ratio of water to oil entering the multiphase separator, wherein the second water cut is representative of a ration of water to oil leaving the multiphase separator, and wherein comparing the first water cut, the second water cut, the liquid rate, or a combination thereof to the predetermined value comprises comparison with an expected estimation value, wherein the expected estimation value is specific to each well in the field; and wherein comparing the water cut, the liquid rate, or a combination thereof to the predetermined value comprises a time series model based on at least a portion of the well test data prior to the comparison.

By way of example, the system may include a diagnostic apparatus configured to communicate with a well test system that is associated with and in fluid communication with a plurality of wells in a field. The system may include at least one processor and memory coupled to the at least one processor. The memory may include instructions that when executed by the at least one processor are configured (e.g., cause a diagnostic apparatus or system) to: compare the well test data to one or more well test descriptors stored in memory; correlate the well test data to an abnormal well test result selected based at least in part on the comparison with the one or more well test descriptors stored in the memory; and transmit an abnormal well test signal indication to a recipient. Further, the system may include a receiving component configured to receive a well test data from the well test system and/or a transmitting component configured to transmit an abnormal well test signal indication and the at least one processor configured to communicate with the transmitting component and the receiving component and to instruct the transmitting component to transmit the abnormal well test signal indication to the recipient.

In yet another configuration, the system may include: a remotely operated valve associated with a field comprising a one or more wells; a multiphase separator configured for well testing the one or more wells; and a diagnostic system. The diagnostic system may include: at least one sensor coupled to the multiphase separator; a communications infrastructure configured to provide communications from the sensor to the diagnostic system; at least one processor; and a memory coupled to the at least one processor, wherein the memory comprises instructions that when executed by the at least one processor are configured to: obtain well test data from at least one sensor; compare the well test data to one or more well test descriptors stored in the memory; correlate the well test data to an abnormal well test result selected based at least in part on the comparison with the one or more well test descriptors stored in the memory; and instruct the transmitting component to transmit the abnormal well test signal indication. The sensors may be pressure, temperature, flow rates or other suitable sensors. The sensors may be disposed on the inlet, outlet or within the vessel for the respective area being monitored.

The well test system may further include wherein the instructions that when executed by the at least one processor are further configured to segment the well test data into a purge period and a test period, wherein the purge period comprises information indicating oil, water, or both leaving a multiphase separator in the well test system, and wherein the test period comprises information indicating oil, water, or both entering the multiphase separator; the instructions that when executed by the at least one processor are further configured to calculate a water cut or at least one liquid rate from the test period well test data, wherein the liquid rate comprises an oil flow rate, a water flow rate, or a combination thereof, and wherein the water cut comprises a ratio of water to oil; wherein the abnormal well test result is selected from a group comprising: an incorrect test duration, an incorrect indication of oil, water or both leaving the multiphase separator, an incorrect indication of oil, water or both entering the multiphase separator, a faulty sensor, a multiphase separator problem, a flow stability problem, an equipment problem external to the multiphase separator, or any combination thereof; an operator interface, wherein the instructions, when executed by the at least one processor are configured to: identify a root cause for the abnormal well test; identify a corrective course of action; and alert an operator of the abnormal well test, the root cause, the corrective course of action, or any combination thereof, via the operator interface; and/or wherein the one or more well test descriptors stored in the memory comprise a first well expected estimation value specific to the first well and a second well estimation value specific to the second well, wherein the first well expected estimation value is different than the second well expected estimation value. The system may also include a plurality of multiphase separators configured for well testing the one or more wells, wherein the diagnostic system is configured to receive well test data from well tests conducted at each of the plurality of multiphase separators. The present techniques may be further understood with reference to FIGS. 1 to 9, which are described further below.

FIG. 1 is a schematic diagram of an exemplary well test system 100 comprising a pad or field 102 having a plurality of wells 104 coupled to a remotely operated valve (ROV) 106. Those of skill in the art understand that a variety of components could suitably replace the ROV 106, and alternate configurations are within the scope of the present disclosure. The ROV 106 is coupled to a multiphase separator 108 such that the ROV 106 can selectively direct flow from one or more wells 104 to the multiphase separator 108. Alternate embodiments may optionally employ one or more additional multiphase separators to perform the techniques described herein within the scope of the present disclosure. The multiphase separator 108 has a divider 110 separating a first compartment 112 and a second compartment 114. The multiphase separator 108 is configured to generally dump and/or pass water out of the first compartment 112 through an outlet controlled by a water outlet dump valve 116 and dump and/or pass oil out of the second compartment 114 an through an outlet controlled by an oil outlet dump valve 118. As may be appreciated, the wells 104, ROV 106 and multiphase separator 108 may be coupled together through various conduits and manifolds to manage the flow of fluids from the wellbore (e.g., production fluids).

In operation, the ROV 106 may couple a well 104 to the multiphase separator 108. Production fluid may be passed into the first compartment 112, wherein oil and water may separate with water occupying a lower part and oil occupying a higher part. Once sufficient fluid passes into the first compartment 112, separated oil flows over the divider 110 into the second compartment 114. Once the oil level in the second compartment 114 reaches a predefined level, the oil outlet dump valve 118 may open and oil may pass out of the second compartment 114. When the oil level in the second compartment 114 reaches a predefined lower level, the oil outlet dump valve 118 may close. Similarly, water level in the first compartment 112 may be monitored, maintained, and/or controlled in substantially the same way, namely, the water outlet dump valve 116 may be opened and closed to control the water level in the first compartment 112 between a predefined upper limit and a predefined lower limit. In some embodiments, the filling-dumping cycle described above may continue in the first compartment 112, the second compartment 114, or both, for multiple iterations in order to obtain sufficient well test data. Flow rates may be measured, e.g., at the water outlet dump valve 116 and/or at the oil outlet dump valve 118. Once a well test is completed, the ROV 106 may couple a second well 104 to the multiphase separator 108. Some embodiments may automate this process, e.g., to allow for frequent well testing.

An initial phase comprising one or more filling-dumping cycles for a well test may be referred to as a purge period. The purge period may serve to cleanse and/or flush out oil and/or water from a prior well test in order to obtain representative well test data results for a selected well. Once the purge period is completed, a diagnostic system (not pictured) may measure and/or calculate liquid rates during the one or more filling-dumping cycles comprising what may be referred to as the test period. The measured and/or calculated rates may be plotted against time and graphically displayed.

By way of example, the well test system 100 may include one or more sensors to manage the flow of fluids for the multiphase separator 108. In one configuration, the oil outlet dump valve 118 may be in communication with a sensor (not shown) that is configured to provide an indication that oil has reached the predefined level within the second compartment 114. The indication may be provided to the oil outlet dump valve 118 or a control unit, which would provide an indication to the to the oil outlet dump valve 118. This sensor may include a float mechanism disposed within the second compartment 114 and in contact with the oil (e.g., buoyancy set to maintain the float in contact with the surface of the oil). Further, the sensor may include a level controller configured to monitor the float level and provide the indication if the predefined level has been reached. Further, the multiphase separator 108 may include one or more sensors in communication with the water outlet dump valve 116. One of these sensors may be configured to monitor the oil level in the first compartment 112, while the second sensor may be configured to monitor the water level in the first compartment 112. These sensors may include individual float mechanisms that are coupled to individual or a shared level controller. The respective float mechanisms are disposed within the first compartment 112 and in contact with the oil or water (e.g., buoyancy set to maintain the float in contact with the surface of the oil or water). Further, the level controller may be configured to monitor the oil or water level and provide an indication if the predefined level has been reached to the water outlet dump valve 116.

Further, the configuration may include a diagnostic system or apparatus that may monitor the well test system and be a component in the well test system. For example, the diagnostic apparatus may include one or more flow rate meters in fluid communication with the water outlet dump valve 116 and the oil outlet dump valve 118. The flow rate meters may provide well test data (e.g., flow rate data for the respective valves) to the diagnostic apparatus, which are part of the well test system. The diagnostic apparatus may include one or more processors, which may communicate with various components and memory (e.g., one or more transmitting components, receiving components; and display components). The memory may include instructions, which when executed by a processor cause the diagnostic apparatus to receive well test data from the well test system (e.g., from a receiving component); to compare the well test data to one or more well test descriptors stored in memory (e.g., local memory or a database); to correlate the well test data to an abnormal well test result selected based at least in part on the comparison with the one or more well test descriptors stored in the memory (e.g., local memory or a database); and to transmit an abnormal well test signal indication (e.g., from a transmitting component, which may involve instructing the transmitting component to transmit an abnormal well test signal indication to a recipient). The instructions may also be configured to extract one or more features from the well test data, wherein the features are selected from a group consisting of quality assurance data, filling-dumping cycle identification data, water cut data, and flow rate change data; and to apply a set of rules comparing the well test data, the features, or both to one or more predefined threshold values to detect an abnormal well test.

Further, in other embodiments, the multiphase separator 108 may include another flow path for gas streams. This additional pathway may include one or more sensors configured to collect data on the gas stream associated with the well test.

By way of example, the exemplary well descriptors for the comparison and correlation are shown in FIGS. 2A to 6C. The well descriptors may include previous well test patterns that are associated with a previous behavior and previous well test measurements. The comparison may involve length of test, number of dumps, time periods between dumps, and other such features.

Figure 2A:
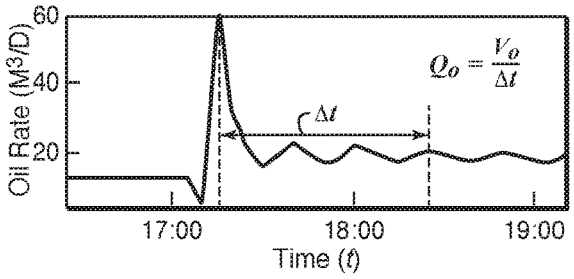
FIG. 2A shows oil rate plotted against time for a well.
Figure 2B:
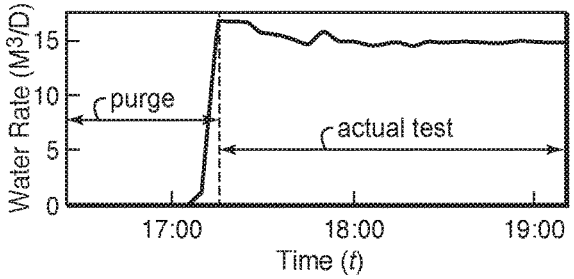
FIG. 2B shows water rate plotted against time for a well.
Figure 2C:
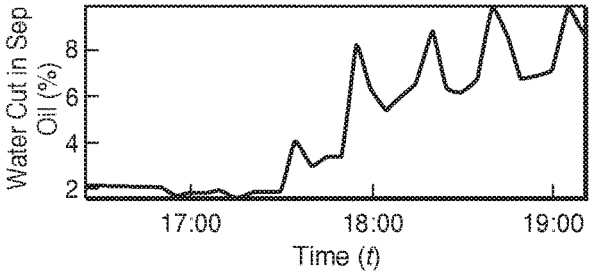
FIG. 2C shows water cut in separated oil plotted against time for a well.

FIGS. 2A, 2B, and 2C show oil rate, water rate, and water cut in separated oil, respectively, plotted against time as measured and/or calculated for a given well, e.g., a well 104 of FIG. 1 during a test period for a well. Other measurements, such as pressure, temperature, etc., may optionally be collected available depending on the configuration of the well test system as understood by those of skill in the art. As depicted in FIG. 2A, the oil rate ($Q_o$) flowing out of a separator, e.g., a multiphase separator 108 of FIG. 1, may be measured in cubic meters per day ($M^3/D$). The oil rate ($Q_o$) may be calculated as the volume of oil flowing out of the separator ($V_o$) (e.g., flow from the oil outlet dump valve 118 of the multiphase separator 108 of FIG. 1) during a given test time ($\Delta t$). Initially, the oil rate ($Q_o$) is constant, reflecting a constant $V_o$. A filling stage begins when $V_o$ is at least partially reduced, e.g., by closing the oil outlet dump valve 118 of FIG. 1. During the filling stage, $\Delta t$ increases and $Q_o$ lowers, thereby creating a valley indicating a filling stage. This valley is followed by a peak as a dumping phase begins, e.g., by opening the oil outlet dump valve 118 of FIG. 1. During the dumping phase, $\Delta t$ increases and $V_o$ increases as oil dumps and/or passes out of the separator, e.g., by opening an oil outlet dump valve 118 of FIG. 1. Multiple peaks and valleys are shown over the depicted $\Delta t$, reflecting multiple filling-dumping cycles during the test time $\Delta t$. The size of the initial peak in FIG. 2A is due to the limited time history; a time series model based on at least a portion of the well test data, e.g., a time-averaging of the calculation, may have a smoothing effect over time as the calculated oil rate becomes smoother, e.g., by approaching a steady state flow rate. Acceptable time series model development techniques include, for example, time-averaging techniques such as autoregressive moving average models. Consequently, as illustrated, for a properly functioning well test system, the oil rate ($Q_o$) converges on the time-averaged oil rate across a given series of filling-dumping cycles.

FIG. 2B shows the water rate for water dumping and/or passing out of a separator, e.g., flowing via the water outlet dump valve 116 at the multiphase separator 108 of FIG. 1. FIG. 2B shows the water rate across a purge and test cycle, e.g., during the purge period and the actual test period described above in the discussion of FIG. 1, as may be measured at an outlet of the separator, e.g., at the water outlet dump valve 116. The water rate in FIG. 2B is measured in $M^3/D$ as compared with time, which may be measured in hours. Similar to FIG. 2A, the size of the initial peak in FIG. 2B may be due to the limited time history; time-averaging of the calculation has a smoothing effect over time as the calculated water rate becomes smoother, e.g., by approaching a steady state flow rate. Where water is produced at a relatively higher rate than oil, the water rate may be expected to exceed the oil rate for a given well test. A higher flow rate may result in faster and/or more frequent filling-dumping cycles, and, consequently, a quicker convergence towards a steady state flow rate.

FIG. 2C shows the water cut in separated oil in a separator, e.g., in the first compartment 112 of the multiphase separator 108 of FIG. 1. The water cut is measured in percentage (%) as compared with time (t), which may be measured in hour. The percentage may be based on volumetric rates. Water cut may be measured by a sensor located by, near, on, and/or in the separator, e.g., integral to or coupled proximate to the oil outlet dump valve 118 of FIG. 1, the second compartment 114 of FIG. 1, etc. Water cut may be used to monitor the quality of separation. For example, poorly separated oil may contain more water than desired. Oil and water should be sufficiently separated and the water cut in separated oil should generally be comparatively low, e.g., between 0% to 20%, 0% to 15%, 0% to 10%, 0% to 8%, 0% to 5%, 0% to 4%, 0% to 3%, 0% to 2%, or 0% to 1%. However, a high water cut does not necessarily mean poor separation. For example, if the dumping period is long, the separated oil in the oil outlet may be further separated by gravity. Sensors positioned in the separated water may return a very high water cut that does not represent the actual water cut in separated oil. The disclosed techniques are capable of differentiating between an incorrectly high or low water cut based on a non-representative sensor location from an incorrectly high or low water cut due to poor separation in the separator or in the water leg.

A valid well test should include oil rates and/or water rates approximating the actual production rates. A valid well test may involve a sufficient duration so as to obtain a measured rate is sufficiently close to the real value. This may additionally or alternatively involve the consistent filling-dumping cycles for a single well test or between well tests for various wells. For example, a significantly longer or shorter filling period than other filling periods may indicate problematic separation. Other variations may indicate other problems.

Figure 3A:
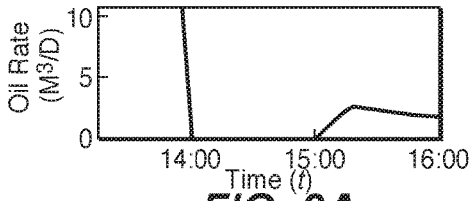
FIG. 3A shows oil rate plotted against time for a well wherein the well test is too short.
Figure 3B:
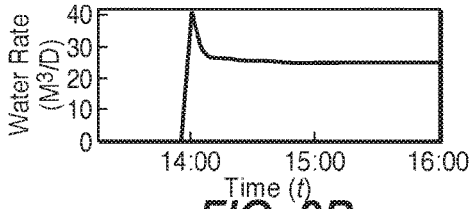
FIG. 3B shows water rate plotted against time for a well wherein the well test is too short.
Figure 3C:
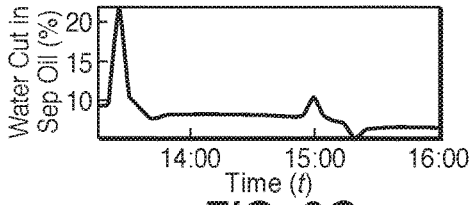
FIG. 3C shows water cut in separated oil plotted against time for a well wherein the well test is too short.

FIGS. 3A, 3B and 3C show oil rate, water rate, and water cut in separated oil, respectively, plotted against time as measured and/or calculated for a given well, e.g., one of the wells 104 of FIG. 1 during a test period for the well. FIG. 3A is a diagram of the oil rate flowing out of a separator (e.g., flowing via the water oil outlet dump valve 118 in a multiphase separator 108 of FIG. 1), and is measured in $M^3/D$ as compared with time (t), which may be measured in hours. FIG. 3B is a diagram of the water rate for water passing out of a separator (e.g., flowing via the water outlet dump valve 116 at the multiphase separator 108 of FIG. 1), and is measured in $M^3/D$ as compared with time (t), which may be measured in hours. FIG. 3C is a diagram of the water cut in the separator, and is measured in percentage (%) as compared with time (t), which may be measured in hours. The percentage may be volumetric. The diagrams for FIGS. 3A, 3B and 3C indicate an invalid and/or low quality well test wherein the well test is too short. The well test shown indicates only one potentially incomplete filling-dumping cycle. As discussed above, reliable calculations may involve analysis of more than one filling-dumping cycle.

Figure 4A:
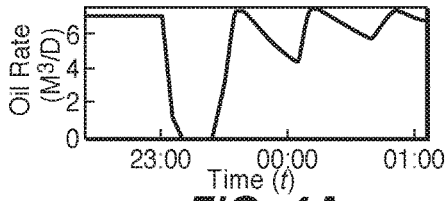
FIG. 4A shows oil rate plotted against time for a well wherein water is dumping over a divider in a separator.
Figure 4B:
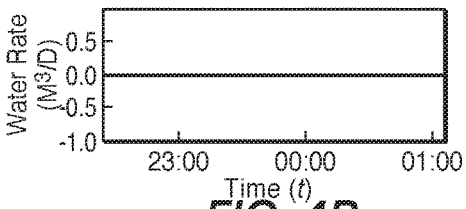
FIG. 4B shows water rate plotted against time for a well wherein water is dumping over a divider in a separator.
Figure 4C:
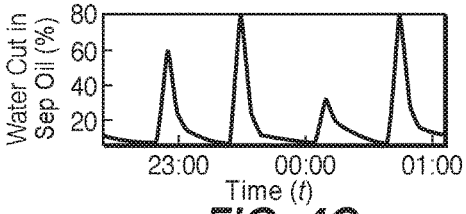
FIG. 4C shows water cut in separated oil plotted against time for a well wherein water is dumping over a divider in a separator.

FIGS. 4A, 4B and 4C show oil rate, water rate, and water cut in separated oil, respectively, plotted against time as measured and/or calculated for a given well, e.g., a well 104 of FIG. 1 during a test period for a well. FIG. 4A is a diagram of the oil rate flowing out of a separator (e.g., flowing via the water oil outlet dump valve 118 in a multiphase separator 108 of FIG. 1), and is measured in $M^3/D$ as compared with time (t), which may be measured in hours. FIG. 4B is a diagram of the water rate for water passing out of a separator (e.g., flowing via the water outlet dump valve 116 at the multiphase separator 108 of FIG. 1), and is measured in $M^3/D$ as compared with time (t), which may be measured in hours. FIG. 4C is a diagram of the water cut in the separator, and is measured in percentage (%) as compared with time (t), which may be measured in hours. The percentage may be volumetric. The diagrams for FIGS. 4A, 4B and 4C indicate an invalid and/or low quality well test wherein water is dumping over a divider in a separator, e.g., the divider 110 of FIG. 1, into an oil side of the separator, e.g., the second compartment 114 of FIG. 1. This may be indicated where, as illustrated, the calculated water rate is zero and the water cut in separated oil is very high. Further, peaks in the water cut line are aligned with the end of the filling cycle indicating potential separation in the oil outlet.

Figure 5A:
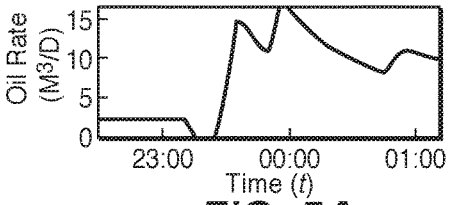
FIG. 5A shows oil rate plotted against time for a well wherein the oil filling-dumping cycle is not consistent.
Figure 5B:
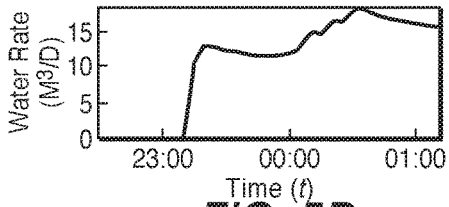
FIG. 5B shows water rate plotted against time for a well wherein the oil filling-dumping cycle is not consistent.
Figure 5C:
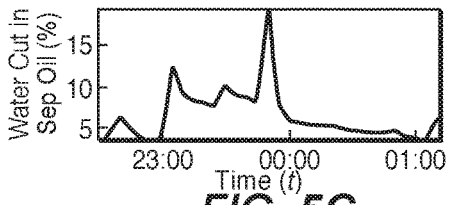
FIG. 5C shows water cut in separated oil plotted against time for a well wherein the oil filling-dumping cycle is not consistent.

FIGS. 5A, 5B and 5C show oil rate, water rate, and water cut in separated oil, respectively, plotted against time as measured and/or calculated for a given well, e.g., a well 104 of FIG. 1 during a test period for a well. FIG. 5A is a diagram of the oil rate flowing out of a separator (e.g., flowing via the water oil outlet dump valve 118 in a multiphase separator 108 of FIG. 1), and is measured in $M^3/D$ as compared with time (t), which may be measured in hours. FIG. 5B is a diagram of the water rate for water passing out of a separator (e.g., flowing via the water outlet dump valve 116 at the multiphase separator 108 of FIG. 1), and is measured in $M^3/D$ as compared with time (t), which may be measured in hours. FIG. 5C is a diagram of the water cut in the separator, and is measured in percentage (%) as compared with time (t), which may be measured in hours. The percentage may be volumetric. The diagrams in 5A, 5B and 5C indicate an invalid and/or low quality well test wherein the oil filling-dumping cycle is not consistent. The second filling period appears significantly longer than the first one.

Figure 6A:
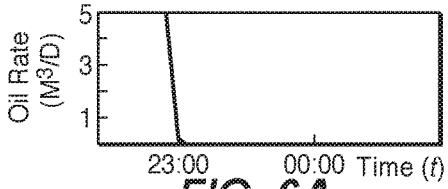
FIG. 6A shows oil rate plotted against time for a well wherein the oil production rate is zero.
Figure 6B:
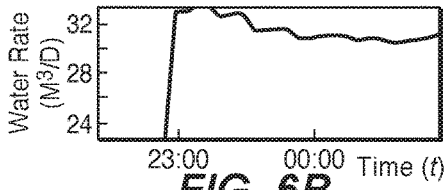
FIG. 6B shows water rate plotted against time for a well wherein the oil production rate is zero.
Figure 6C:
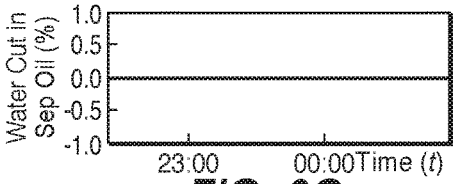
FIG. 6C shows water cut in separated oil plotted against time for a well wherein the oil production rate is zero.

FIGS. 6A, 6B and 6C show oil rate, water rate, and water cut in separated oil, respectively, plotted against time as measured and/or calculated for a given well, e.g., a well 104 of FIG. 1 during a test period for a well. FIG. 6A is a diagram of the oil rate flowing out of a separator (e.g., flowing via the water oil outlet dump valve 118 in a multiphase separator 108 of FIG. 1), and is measured in $M^3/D$ as compared with time (t), which may be measured in hours. FIG. 6B is a diagram of the water rate for water passing out of a separator (e.g., flowing via the water outlet dump valve 116 at the multiphase separator 108 of FIG. 1), and is measured in $M^3/D$ as compared with time (t), which may be measured in hours. FIG. 6C is a diagram of the water cut in the separator, and is measured in percentage (%) as compared with time (t), which may be measured in hours. The percentage may be volumetric. The diagrams for FIGS. 6A, 6B and 6C indicate an invalid and/or low quality well test wherein the oil production rate is zero. A zero or near-zero oil rate may be a valid well test when the well is producing no oil (e.g., due to pump issue). Alternately, the zero or near-zero oil rate may indicate that the test is not long enough or a separation issue exists. Consequently, in some embodiments, a diagnostic system may indicate that a problem exists and additional investigation and/or troubleshooting is necessary.

Figure 7:
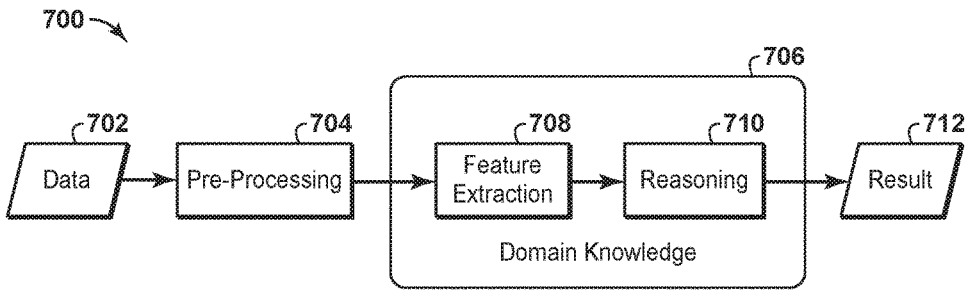
FIG. 7 is a high-level schematic flowchart of a diagnostic system.

FIG. 7 is a high-level schematic flowchart of a diagnostic system 700, e.g., a diagnostic system for a well test system 100 of FIG. 1. The diagnostic system 700 may be implemented as a software system having a data historian and/or database connection component (not depicted) for use as a repository for well test comparison data, e.g., well tests for particular wells, well tests indicating erroneous operation, etc. The diagnostic system 700 may receive data 702, such as well test data from a well test system, which may be the well test system 100 of FIG. 1, for example. At pre-processing component 704, the diagnostic system 700 may perform pre-processing of the data, such as one or more conventional signal processing techniques. At the domain knowledge function component 706, the diagnostic system 700 may perform a domain knowledge function comprising a feature extraction component 708, wherein the data may be analyzed for one or more features, and wherein data may be converted into high level information, e.g., descriptors, for subsequent analysis, and a reasoning component 710, wherein one or more of the features is compared with well test comparison data, e.g., one or more descriptors stored in a memory (e.g., local memory or a database). As understood by those of skill in the art, well test descriptors may be univariate (e.g., mean, standard deviation, maximum, minimum, number of peaks, etc.) and/or multivariate (e.g., covariance matrix, cross-correlation, mutual information, etc.) statistical features extracted from data. The reasoning component 710 may further include one or more knowledge engines (not depicted) for analyzing the processed data, applying one or more decision rules, and determining whether a well test is normal and/or valid, or abnormal, e.g., invalid, valid with warning, etc. The knowledge engine may also provide an explanation of the analysis results, a root cause analysis of problematic tests, and/or one or more recommendations of actions to operators for investigation, correction, mitigation, etc. In some embodiments, the domain knowledge function component 706 comprises a configuration tool that allows users to fine-tune the reasoning component 710 (e.g., inputting well-specific parameters, times of life, maintenance parameters, adjusting rule thresholds, etc.). Also, the diagnostic system 700 may comprise a reporting component 712 for outputting a result, e.g., indication of an abnormal well test. The indication may be output in various formats. For example, the results can be sent as instructions to transmit an abnormal well test signal indication for display to an operator, e.g., on a computer. Other embodiments may print or email one or more results to users. Still other embodiments may generate high-level summaries of the results (e.g., statistics of well tests results and root causes). Such outputs and indications are well known and all such variations are considered within the scope of this disclosure.

Figure 8:
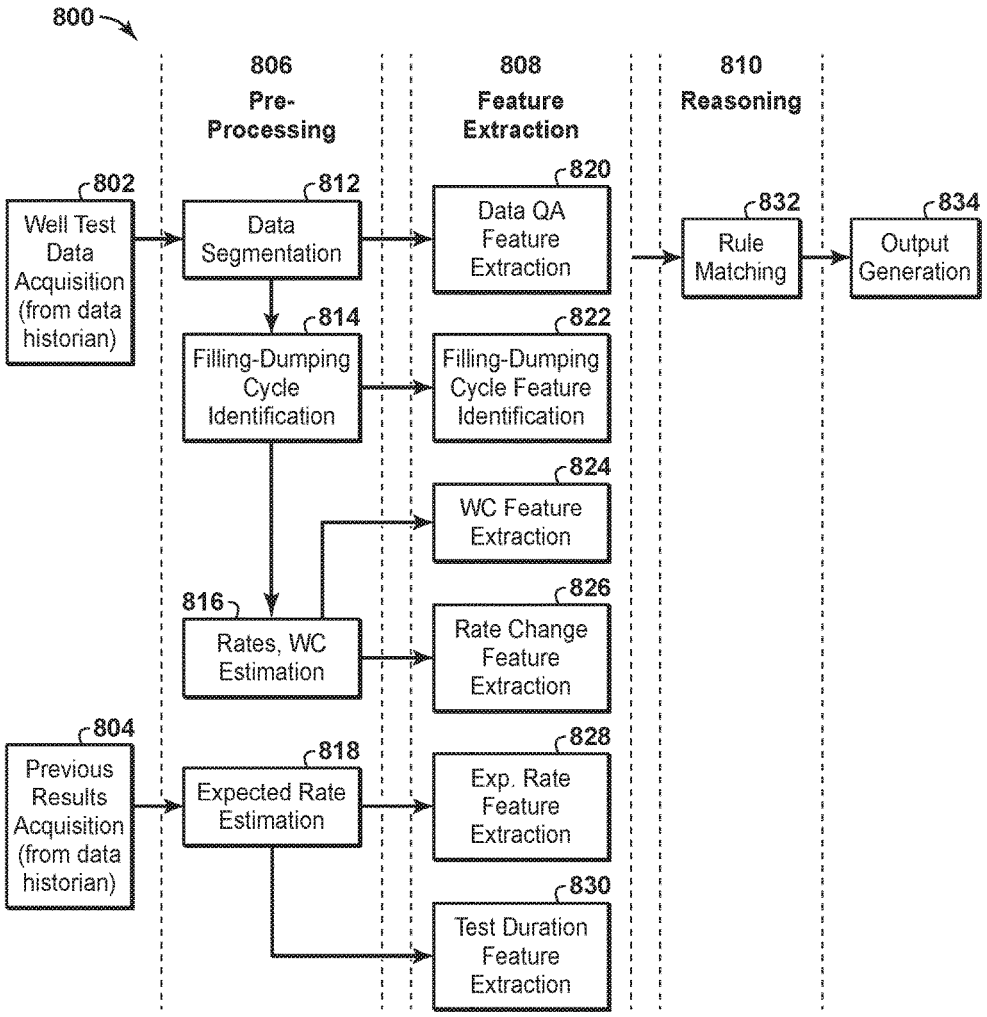
FIG. 8 is a detailed schematic flowchart of a diagnostic system.

FIG. 8 is a detailed schematic flowchart of a diagnostic system 800, e.g., the diagnostic system 700 of FIG. 7. The components of FIG. 8 may be substantially the same as the corresponding components of FIG. 7 except as otherwise indicated. The detailed schematic contains arrows to illustrate potential inputs; various embodiments may utilize additional and/or alternate inputs to perform the various tasks so as to obtain a desired performance characteristic. The diagnostic system 800 may include a well test data acquisition component 802 configured to receive data, e.g., well test data, from a well test system, e.g., the well test system 100 of FIG. 1. Also, the diagnostic system 800 may include a previous result acquisition component 804 configured to obtain or acquire previous results, such as previous well test data and/or comparison well test data, e.g., from a data historian tasked with storing a repository comprising one or more comparison well test data. The well test data acquisition component 802 may be performed independently from and in any sequence with previous result acquisition component 804.

In the pre-processing component 806, the diagnostic system 800 may perform one or more pre-processing functions on the well test data from the well test data acquisition component 802, such as data segmentation component 812 (e.g., segmenting a test period from a purge period), filling-dumping cycle identification component 814, and/or water cut (WC) estimation component 816 configured to estimate oil flow rate, water flow rate, and/or water cut in separated oil (e.g., using production equipment information, such as pump rate, a well's production cycle, data indicating performance of neighboring wells in similar production regimes, etc.), in order to identify data corresponding to specific portions of the well test. Separately or concurrently, the diagnostic system 800 may alternately or additionally include an expected rate estimation component 818 configured to perform an expected oil flow rate, water flow rate, and/or water cut in separated oil estimation task in preparation for a domain knowledge function, e.g., the domain knowledge function component 706 of FIG. 7, comprising a feature extraction component 808 and a reasoning component 810.

In the feature extraction component 808, the diagnostic system 800 may perform one or more feature extraction function tasks, e.g., through data transformation and/or signal processing, wherein feature extraction functions may include one or more of data quality assurance (QA) extraction component 820, filling-dumping cycle feature identification component 822, water cut feature extraction component 824, flow rate change feature extraction component 826, expected flow rate feature extraction component 828, and test duration feature extraction component 830. The data quality assessment (QA) extraction component 820 may be configured to perform differentiation regarding whether the obtained measurements are actual versus interpolated data from the data historian. Interpolated data through extended periods of time may be misleading and/or otherwise inaccurate and may be unsuitable for well test validation. Alternately or additionally, identification of issues requiring additional investigation may occur, e.g., as described with respect to FIGS. 6A to 6C. The filling-dumping cycle feature identification component 822 may calculate features that measure filling-dumping cycle consistency. For example, if multiple filling-dumping cycles have roughly the same duration, then the separator may be considered to have consistent filling-dumping cycles. If, however, one period is appreciably longer or appreciably shorter than others, the filling-dumping cycles are inconsistent and investigation may be required to identify a cause of and/or prevent abnormal and/or invalid well tests. The water cut feature extraction component 824 may check whether a water cut calculation is representative, e.g., by comparing the estimated water cut with values from a recent water cut and/or by calculating an expected water cut using the sensor location and the filling period duration. For example, when the filling period is too short the separated oil may not have time to sufficiently separate in the oil compartment, e.g., the second compartment 114 of FIG. 1. Also, when the sensor improperly positioned an erroneously high water cut may result providing a false indication of poor separation, e.g., as discussed in FIGS. 4A to 4C. The flow rate change feature extraction component 826 may compare current well test oil flow rates and/or water flow rates with recent flow rates from the same well. Similar production conditions for a given well should result in similar flow rates at the separator and, consequently, differences between flow rates may indicate an invalid, low quality, and/or otherwise abnormal well test. The expected flow rate change feature extraction component 828 may calculate the difference between (i) expected and/or estimated values as obtained from the data historian, and (ii) measured values from the well test data, with significant deviations indicating an invalid and/or abnormal well test. The test duration feature extraction component 830 may measure the expected test duration given the expected flow rates. Lower production rates may require longer test periods and, consequently, insufficiently long well tests may not provide adequate time to obtain representative flow rates.

In the reasoning component 810, the diagnostic system 800 may include one or more rule matching component 832 configured to perform rule matching with one or more decision rules. Decision rules may encode the domain knowledge from experts and/or may encode knowledge discovered through data mining, e.g., using a statistical analysis and/or a machine learning algorithm analysis on historical data for the well, the pad, the separator, the field, the reservoir, similar reservoirs, etc. Acceptable statistical analysis techniques include, for example, time-frequency analysis, e.g., a Fourier transform analysis, a wavelet analysis, etc. Some embodiments may alternatively or additionally utilize one or more other analytical techniques, e.g., peak detection analysis, to obtain metrics suitable for aiding analysis. A rule may contain threshold conditions and/or values for detecting abnormal well tests. Decision rules may dynamically and/or adaptively adjust these thresholds over time, e.g., using a statistical analysis and/or a machine learning algorithm analysis on historical data for the well, the pad, the separator, the field, the reservoir, similar reservoirs, etc. For example, a decision rule may specify that when oil flow rates are inconsistent such that the oil flow rate has increased while water flow rates have decreased by a proportionally similar amount with respect to past well tests and a high water cut is present, an abnormal well test is indicated, a water overflow problem is likely, and the water dump valve, e.g., the water outlet dump valve 116 of FIG. 1, should be investigated for improper operation. Some decision rules may indicate an abnormal well test, such as an invalid well test, a warning situation indicative of a potential problem, an unexpected indication, or any combination thereof. As described, a decision rule may include a root cause and/or a recommended course of correcting, investigating, and/or mitigating action. Decision rules may be assigned hierarchical priority rankings to resolve conflicts when multiple decision rules are triggered. Such rankings may be performed by users, by data analysis, or a combination thereof. Decision rules may be categorized as rules regarding scheduling (e.g., unsuitable well test duration), data availability and/or quality (e.g., missing data), sensor health (e.g., failed sensor), separation conditions, processes, and separator health (e.g., water overflow), flow stability and patterns (e.g., lifetime changes), equipment failure and conditions (e.g., stuck open drain valves), etc.

The output of the reasoning component 810 may pass to an output generation component 834. The output generation component 834 may instruct the diagnostic system 800 to transmit an abnormal well test signal indication, such as an alert, to a designated recipient. The indication may be output in various formats. For example, the results can be sent as instructions to transmit an abnormal well test signal indication via computer communications for display to an operator, e.g., on a computer. Other embodiments may print results and/or email results to one or more users. Still other embodiments may generate high-level summaries of the results (e.g., statistics of well tests results, statistics regarding root causes of abnormal conditions, etc.). Such outputs and indications are well known and all such variations are considered within the scope of this disclosure.

Those of skill in the art will appreciate that some embodiments may perform one or more components and/or tasks in parallel, in series, in a different sequence, or any combination thereof. Also, other embodiments will comprise alternate and/or additional tasks as required to obtain a desired result. For example, in some embodiments the data QA feature extraction component 820 may be part of the preprocessing component 806. Further, in some embodiments, information from neighboring wells with similar production profiles may be included in the decision process of the diagnostic system 800. Moreover, in some embodiments, the decision rules may be replaced by one or more machine learning methods such as Naïve Bayes, decision tree, K nearest neighbor, etc. All such alternate and/or additional tasks and performance characteristics are considered within the scope of this disclosure.

Figure 9:
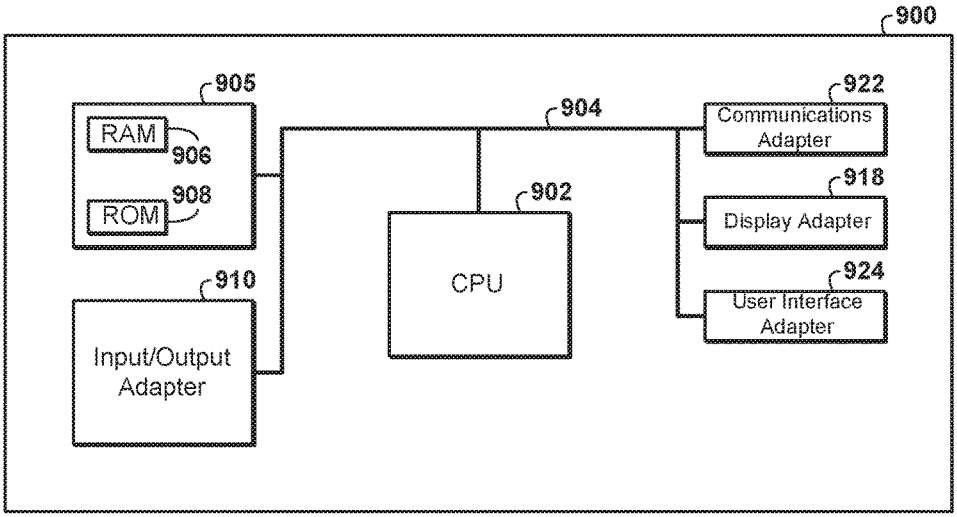
FIG. 9 is a block diagram of a general purpose computer system.

FIG. 9 is a block diagram of a general purpose computer system 900 suitable for implementing one or more embodiments of the components described herein. The computer system 900 comprises a central processing unit (CPU) 902 coupled to a system bus 904. The CPU 902 may be any general-purpose CPU or other types of architectures of CPU 902 (or other components of exemplary system 900), as long as CPU 902 (and other components of system 900) supports the operations as described herein. Those of ordinary skill in the art will appreciate that, while only a single CPU 902 is shown in FIG. 9, additional CPUs may be present. Moreover, the computer system 900 may comprise a networked, multi-processor computer system that may include a hybrid parallel CPU/Graphics Processing Unit (GPU) system (not depicted). The CPU 902 may execute the various logical instructions according to various embodiments. For example, the CPU 902 may execute machine-level instructions for performing processing according to the operational flow described above in conjunction with FIG. 2.

The computer system 900 may also include computer components such as non-transitory, computer-readable media or memory 905. The memory 905 may include a RAM 906, which may be SRAM, DRAM, SDRAM, or the like. The memory 905 may also include additional non-transitory, computer-readable media such as a Read-Only-Memory (ROM) 908, which may be PROM, EPROM, EEPROM, or the like. RAM 906 and ROM 908 may hold user data, system data, data store(s), process(es), and/or software, as known in the art. The memory 905 may suitably store predefined configuration data and/or placement information, e.g., a diagnostic system software suite, a data historian or database comprising well test comparison data, a knowledge engine, a machine learning algorithm, or other such instructions as explained above with respect to FIGS. 7 and/or 8. The computer system 900 may also include an input/output (I/O) adapter 910, a communications adapter 922, a user interface adapter 924, and a display adapter 918.

The I/O adapter 910 may connect one or more additional non-transitory, computer-readable media such as an internal or external storage device (not depicted), including, for example, a hard drive, a compact disc (CD) drive, a digital video disk (DVD) drive, a floppy disk drive, a tape drive, and the like to computer system 900. The storage device(s) may be used when the memory 905 is insufficient or otherwise unsuitable for the memory requirements associated with storing data for operations of embodiments of the present techniques. The data storage of the computer system 900 may be used for storing information and/or other data used or generated as disclosed herein. For example, storage device(s) 912 may be used to store configuration information or additional plug-ins in accordance with an embodiment of the present techniques. Further, user interface adapter 924 may couple to one or more user input devices (not depicted), such as a keyboard, a pointing device and/or output devices, etc. to the computer system 900. The CPU 902 may drive the display adapter 918 to control the display on a display device (not depicted), e.g., a computer monitor or handheld display, to, for example, present information to the user regarding location.

The computer system 900 further includes communications adapter 922. The communications adapter 922 may comprise one or more separate components suitably configured for computer communications, e.g., one or more transmitters, receivers, transceivers, or other devices for sending and/or receiving signals, for example, well test data, abnormal well test signal indications, etc. The computer communications component 926 may be configured with suitable hardware and/or logic to send data, receive data, or otherwise communicate over a wired interface or a wireless interface, e.g., carry out conventional wired and/or wireless computer communication, radio communications, near field communications (NFC), optical communications, scan an RFID device, or otherwise transmit and/or receive data using any currently existing or later-developed technology. In some embodiments, the communications adapter 922 is configured to receive and interpret one or more signals indicating location, e.g., a GPS signal, a cellular telephone signal, a wireless fidelity (Wi-Fi) signal, etc.

The architecture of system 900 may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. Additional alternative computer architectures may be suitably employed, e.g., utilizing one or more operably connected external components to supplement and/or replace an integrated component. In fact, persons of ordinary skill in the art may use any number of suitable structures capable of executing logical operations according to the embodiments. In an embodiment, input data to the computer system 900 may include various plug-ins and library files. Input data may additionally include configuration information.

By way of example, the system may include a diagnostic apparatus configured to communicate with a well test system that is associated with and in fluid communication with a plurality of wells in a field. The system may include at least one processor and memory coupled to the at least one processor. The memory may include instructions that when executed by the at least one processor are configured (e.g., cause a diagnostic apparatus or system) to: compare the well test data to one or more well test descriptors stored in memory; correlate the well test data to an abnormal well test result selected based at least in part on the comparison with the one or more well test descriptors stored in the memory; and transmit an abnormal well test signal indication to a recipient. Further, the system may include a receiving component configured to receive a well test data from the well test system and/or a transmitting component configured to transmit an abnormal well test signal indication and the at least one processor configured to communicate with the transmitting component and the receiving component and to instruct the transmitting component to transmit the abnormal well test signal indication to the recipient.

In certain configurations, the diagnostic apparatus may include various enhancements. For example, the diagnostic apparatus may be configured to: extract one or more features from the well test data, wherein the features are selected from a group consisting of quality assurance data, filling-dumping cycle identification data, water cut data, and flow rate change data; and apply a set of rules comparing the well test data, the features, or both to one or more predefined threshold values to detect an abnormal well test. Also, the diagnostic apparatus may be configured to: calculate at least one of a water cut, an oil flow rate, a water flow rate, an expected water cut, an expected oil flow rate, an expected water flow rate, an oil flow rate change, or a water flow rate change from the well test data; to receive well test data from a plurality of well test systems (e.g., via the receiving component); store the well test data in the memory, such as local memory or a database, as a comparison well test data for a subsequent well test; filter the well test data over time using time averaging or exponential smoothing; pass the well test data through a signal processing algorithm; perform a statistical analysis on the well test data using a time-frequency analysis or a peak detection analysis; and/or provide an operator with an explanation of the abnormal well test signal indication, a root cause of the abnormal well test signal indication, a recommended course of action in response to the abnormal well test signal indication, or any combination thereof.

In other configurations, the system may be configured to detect an abnormal well test in a well test system associated with a plurality of wells in a field. The system may include instructions configured to obtain a well test data from the well test system; segment the well test data into a purge period and a test period, wherein the purge period comprises information indicating oil, water, or both leaving a multiphase separator in the well test system, and wherein the test period comprises information indicating oil, water, or both entering the multiphase separator; calculate a water cut or at least one liquid rate from the test period well test data, wherein the liquid rate comprises an oil flow rate, a water flow rate, or a combination thereof; compare the water cut, the liquid rate, or a combination thereof to a predetermined value; and detect the abnormal well test based on the comparison. The system may further include instructions configured to identify a root cause for the abnormal well test; identify a corrective course of action; alert an operator to the abnormal well test, the root cause, the corrective course of action, or a combination thereof; calculate a second water cut from the test period well test data, wherein the first water cut is representative of a ratio of water to oil entering the multiphase separator, wherein the second water cut is representative of a ration of water to oil leaving the multiphase separator, and wherein comparing the first water cut, the second water cut, the liquid rate, or a combination thereof to the predetermined value comprises comparison with an expected estimation value, wherein the expected estimation value is specific to each well in the field; and/or wherein comparing the water cut, the liquid rate, or a combination thereof to the predetermined value comprises a time series model based on at least a portion of the well test data prior to the comparison. Moreover, the instructions may include the predetermined value being selected to identify an incorrect test duration, an incorrect indication of oil, water or both leaving the multiphase separator, an incorrect indication of oil, water or both entering the multiphase separator, a faulty sensor, a multiphase separator problem, a flow stability problem, an equipment problem external to the multiphase separator, or any combination thereof and wherein the abnormal well test indicates an incorrect test period duration, an incorrect filling period duration, a non-uniform dump-fill cycle duration, a low oil flow rate, an incorrect water cut, or any combination thereof.

In other configurations, the system may be configured to detect an abnormal well test in a well test system associated with a plurality of wells in a field. The well test system may include: a remotely operated valve associated with a field comprising a one or more wells; a multiphase separator configured for well testing the one or more wells; and a diagnostic system. The diagnostic system may include: at least one sensor coupled to the multiphase separator; a communications infrastructure configured to provide communications from the sensor to the diagnostic system; at least one processor; and a memory coupled to the at least one processor, wherein the memory comprises instructions that when executed by the at least one processor are configured to: obtain well test data from at least one sensor; compare the well test data to one or more well test descriptors stored in the memory; correlate the well test data to an abnormal well test result selected based at least in part on the comparison with the one or more well test descriptors stored in the memory; and instruct the transmitting component to transmit the abnormal well test signal indication.

The well test system may further include wherein the instructions that when executed by the at least one processor are further configured to segment the well test data into a purge period and a test period, wherein the purge period comprises information indicating oil, water, or both leaving a multiphase separator in the well test system, and wherein the test period comprises information indicating oil, water, or both entering the multiphase separator; the instructions that when executed by the at least one processor are further configured to calculate a water cut or at least one liquid rate from the test period well test data, wherein the liquid rate comprises an oil flow rate, a water flow rate, or a combination thereof, and wherein the water cut comprises a ratio of water to oil; wherein the abnormal well test result is selected from a group comprising: an incorrect test duration, an incorrect indication of oil, water or both leaving the multiphase separator, an incorrect indication of oil, water or both entering the multiphase separator, a faulty sensor, a multiphase separator problem, a flow stability problem, an equipment problem external to the multiphase separator, or any combination thereof; an operator interface, wherein the instructions, when executed by the at least one processor are configured to: identify a root cause for the abnormal well test; identify a corrective course of action; and alert an operator of the abnormal well test, the root cause, the corrective course of action, or any combination thereof, via the operator interface; and/or wherein the one or more well test descriptors stored in the memory comprise a first well expected estimation value specific to the first well and a second well estimation value specific to the second well, wherein the first well expected estimation value is different than the second well expected estimation value. The system may also include a plurality of multiphase separators configured for well testing the one or more wells, wherein the diagnostic system is configured to receive well test data from well tests conducted at each of the plurality of multiphase separators.

While the present techniques may be susceptible to various modifications and alternative forms, the exemplary embodiments discussed herein have been shown only by way of example. However, it should again be understood that the techniques disclosed herein are not intended to be limited to the particular embodiments disclosed. Indeed, the present techniques include all alternatives, modifications, combinations, permutations, and equivalents falling within the scope of the disclosure and appended claims.

What is claimed is:

1. A diagnostic apparatus configured to communicate with a well test system comprising a plurality of wells in a field, comprising:

a receiving component configured to receive well test data from the well test system;

a transmitting component configured to transmit an abnormal well test signal indication;

at least one processor configured to communicate with the transmitting component and the receiving component; and a memory coupled to the at least one processor, wherein the memory comprises instructions that when executed by the at least one processor are configured to:

obtain well test data from the well test system;

segment the well test data into purge period data and test period data;

extract one or more features from the well test data, wherein the one or more features comprise quality assurance data, filling-dumping cycle identification data, water cut data, flow rate change data, expected flow rate data, test duration data, and combinations thereof;

calculate a first water cut from the test period data, wherein the first water cut comprises a ratio of water to oil entering the multiphase separator;

calculating a second water cut from the test period data, wherein the second water cut is representative of a ratio of water to oil leaving the multiphase separator compare the one or more features, the first water cut, and the second water cut, to one or more well test descriptors stored in the memory;

identify the well test data as an abnormal well test result based at least in part on the comparison of the one or more features with the one or more well test descriptors;

determine, based at last in part on the comparison of the one or more features with the one or more well test descriptors, an explanation of the abnormal well test result, a root cause of the abnormal well test result, a recommended course of action in response to the abnormal well test result, or any combination thereof; and instruct the transmitting component to transmit an indication of the abnormal well test result to a recipient and to transmit the explanation of the abnormal well test result, the root cause of the abnormal well test result, the recommended course of action, or a combination thereof to the recipient.

2. The diagnostic apparatus of claim 1, wherein the instructions, when executed by the at least one processor are further configured to:

apply a set of rules comparing the well test data, the one or more features, or both to one or more predefined threshold values to detect an abnormal well test.

3. The diagnostic apparatus of claim 1, wherein the receiving component is configured to receive the well test data from a plurality of well test systems.

4. The diagnostic apparatus of claim 1, wherein the instructions, when executed by the at least one processor are configured to calculate at least one of an oil flow rate, a water flow rate, an expected water cut, an expected oil flow rate, an expected water flow rate, an oil flow rate change, or a water flow rate change from the well test data.

5. The diagnostic apparatus of claim 1, wherein the instructions, when executed by the at least one processor are configured to store the well test data in the memory as a comparison well test data for a subsequent well test.

6. The diagnostic apparatus of claim 1, further comprising at least one of:

filtering the well test data over time using time averaging or exponential smoothing;

passing the well test data through a signal processing algorithm; or performing a statistical analysis on the well test data using a time-frequency analysis or a peak detection analysis.

7. The diagnostic apparatus of claim 1, wherein the one or more well test descriptors comprise univariate statistical features, multivariate statistical features, or combinations thereof extracted from comparison well test data stored in memory.

8. A method of detecting an abnormal well test in a well test system comprising a plurality of wells in a field, comprising:

receiving a well test data from the well test system;

segmenting the well test data into a purge period and a test period, wherein the purge period comprises information indicating oil, water, or both leaving a multiphase separator in the well test system, and wherein the test period comprises information indicating oil, water, or both entering the multiphase separator;

calculating a first water cut from the test period well test data, wherein the first water cut is representative of a ratio of water to oil entering the multiphase separator;

calculating a second water cut from the test period well test data, wherein the second water cut is representative of a ratio of water to oil leaving the multiphase separator; comparing the first water cut, the second water cut, the liquid rate, or a combination thereof to a predetermined value, wherein the predetermined value comprises an expected estimation value that is specific to each well in the field; detecting the abnormal well test based on the comparison; identify a root cause for the abnormal well test; identify a corrective course of action; and output an alert to an operator of the abnormal well test, the root cause, the corrective course of action, or a combination thereof.

9. The method of claim 8, wherein the abnormal well test indicates an incorrect test period duration, an incorrect filling period duration, a non-uniform dump-fill cycle duration, a low oil flow rate, an incorrect water cut, or any combination thereof.

10. The method of claim 8, wherein the predetermined value is selected to identify an incorrect test duration, an incorrect indication of oil, water or both leaving the multiphase separator, an incorrect indication of oil, water or both entering the multiphase separator, a faulty sensor, a multiphase separator problem, a flow stability problem, an equipment problem external to the multiphase separator, or any combination thereof.

11. The method of claim 8, wherein comparing the first water cut, the second water cut, or a combination thereof to the predetermined value comprises a time series model based on at least a portion of the well test data prior to the comparison.

12. A well test system, comprising:

a remotely operated valve associated with a field comprising a one or more wells;

a multiphase separator configured for well testing the one or more wells;

at least one sensor coupled to the multiphase separator;

a communications infrastructure configured to provide communications from the sensor to the diagnostic system; a diagnostic system comprising:

at least one processor; and a memory coupled to the at least one processor, wherein the memory comprises instructions that when executed by the at least one processor are configured to: obtain well test data from the at least one sensor;

segment the well test data in order to identify data corresponding to specific portions of the well test, wherein the specific portions of the well test data comprise one or more of purge period data, test period data, and filling- dumping cycle data;

extract one or more features from the well test data, wherein the one or more features comprise quality assurance data, filling-dumping cycle identification data, water cut data, flow rate change data, expected flow rate data, test duration data, and combinations thereof;

calculate a first water cut from the well test data, wherein the first water cut comprises a ratio of water to oil entering the multiphase separator;

calculate a second water cut from the well test data, wherein the second water cut is representative of a ratio of water to oil leaving the multiphase separator;

compare the first water cut, the second water cut, and the one or more features to one or more decision rules stored in the memory, wherein the one or more decision rules contain threshold conditions for detecting abnormal well test results;

identify the well test data as an abnormal well test result based at least in part on the comparison; and output an indication of the abnormal well test result.

13. The well test system of claim 12, wherein the abnormal well test result is selected from a group comprising: an incorrect test duration, an incorrect indication of oil, water or both leaving the multiphase separator, an incorrect indication of oil, water or both entering the multiphase separator, a faulty sensor, a multiphase separator problem, a flow stability problem, an equipment problem external to the multiphase separator, or any combination thereof.

14. The well test system of claim 13, further comprising an operator interface, wherein the instructions, when executed by the at least one processor are configured to:

identify a root cause for the abnormal well test;

identify a corrective course of action; and alert an operator of the abnormal well test, the root cause, the corrective course of action, or any combination thereof, via the operator interface.

15. The well test system of claim 12, further comprising a plurality of multiphase separators configured for well testing the one or more wells, wherein the diagnostic system is configured to receive well test data from well tests conducted at each of the plurality of multiphase separators.

16. The well test system of claim 12, wherein the one or more decision rules utilize statistical analysis techniques, machine learning algorithm analysis techniques, or combinations thereof on historical data for the one or more wells, the multiphase separator, or the reservoir.

17. The well test system of claim 16, wherein the statistical analysis techniques comprise time-frequency analysis or wavelet analysis.

* * * * *